United States Patent [19]

Buerger

[11] 4,311,300

[45] Jan. 19, 1982

[54] POST FOOTING BRACING AND SPACING APPARATUS

[76] Inventor: Eddy C. Buerger, 1077 Dorothy St., El Cajon, Calif. 92020

[21] Appl. No.: 202,633

[22] Filed: Oct. 31, 1980

[51] Int. Cl.[3] ..... E04H 17/00

[52] U.S. Cl. ..... 256/1; 256/19

[58] Field of Search ..... 256/19, 1; 52/742, 749, 52/297

[56] References Cited

U.S. PATENT DOCUMENTS

| | | | |
|---|---|---|---|
| 1,031,049 | 7/1912 | Conzelman | 52/749 |
| 1,429,084 | 9/1922 | Loeffler | 256/19 |
| 1,503,902 | 8/1924 | Jones | 256/19 |
| 3,385,566 | 5/1968 | Dwyer | 256/19 |

*Primary Examiner*—Andrew V. Kundrat

*Attorney, Agent, or Firm*—Linda R. Neyenesch

[57] ABSTRACT

A post footing bracing and spacing apparatus for accurately holding a post or plurality of posts in alignment. The apparatus is preferably used in the construction of fences composed of preformed materials where precise alignment and distance between posts is critical. The apparatus consists of a plurality of clamps and spacing bars. The clamps are designed to snugly abut preformed posts of various dimensions. A first clamp lies upon the ground above a dughole and holds a preformed pole in place in the dughole. At least a second clamp is attached further up the post. Accurate spacing and steadying is provided by a spacing bar which attaches or snugs up to the clamps. The spacing bars communicate with at least another post and clamp assembly, and precise placement of poles in linear arrangement is accomplished. After the assembly is secured, application of permanent footing material, such as poured concrete, can be accomplished without disturbing alignment of the poles. After the permanent footing has solidified, the clamps and spacers are removed and the posts are fixed in accurate alignment both vertically and between each other.

2 Claims, 6 Drawing Figures

POST FOOTING BRACING AND SPACING APPARATUS

TECHNICAL FIELD

The invention is in the field of post footing bracing and spacing and more particularly for bracing and spacing of fences composed of preformed materials which must be precisely positioned.

BACKGROUND OF THE INVENTION

Prior art devices totally lack a means and/or method for spatially aligning the parts of a preformed fence, such as concrete, having vertical and horizontal components which must accurately line up relative to one another. The lining up and setting of footings is extremely critical in this regard. Posts are most often placed in a dughole and the dughole is then filled in with a holding medium, such as poured concrete. Steadying of the post while the holding medium is setting up is yet another problem which the prior art has failed to solve. Prior art devices often employ a collar which is placed around a post close to the ground. Attached to the collar are a plurality of radiating rods which extend downwardly and obliquely, to lie upon the ground without any attachment means, i.e., the rods do not mate with any stabilizing structure on the ground. Although the base may be held relatively fixed with this method, the lack of rod attachment means renders the device tenuous, especially in view of potential sway of the upper part of the post. This problem renders the post position totally inoperative in terms of lining up with horizontal cross members and other posts, a well as aesthetic considerations.

SUMMARY OF THE INVENTION

An object of the present invention is the provision of a plurality of clamps which hold a preformed post in alignment within a dughole.

Another object is the provision of a space bar for accurately placing a first post relative to a second post.

Yet another object is the provision of a clamping and spacing assembly which holds a plurality of posts in fixed relationship while the foundation of the respective dugholes is solidifying.

These and other objects are achieved by a plurality of clamps which encompass a preformed post. The post sits within a dughole in the ground. A first clamp is situated around the post and upon the ground. The first clamp is considerably longer than upper clamps for maximum leverage. Upper clamps are situated distally of the lower clamp and proximal to the upper portion of the post. Both clamps have attachment means for securing a space bar relative to a first post and a second post. The first clamp and space bar provide alignment of the post within the dughole, as well as maintaining a precise spatial relationship between respective dugholes and posts. The second clamp prevents vertical sway of the post and also provides precise spatial dispostion between posts.

The foregoing combination of spacing features are critical in the construction of preformed structural members, not only for an effective method and means for steadying the posts while base foundations are setting up, but also for subsequent placement of cross bars between posts.

DETAILED DESCRIPTION OF THE DRAWING

Figure 1:
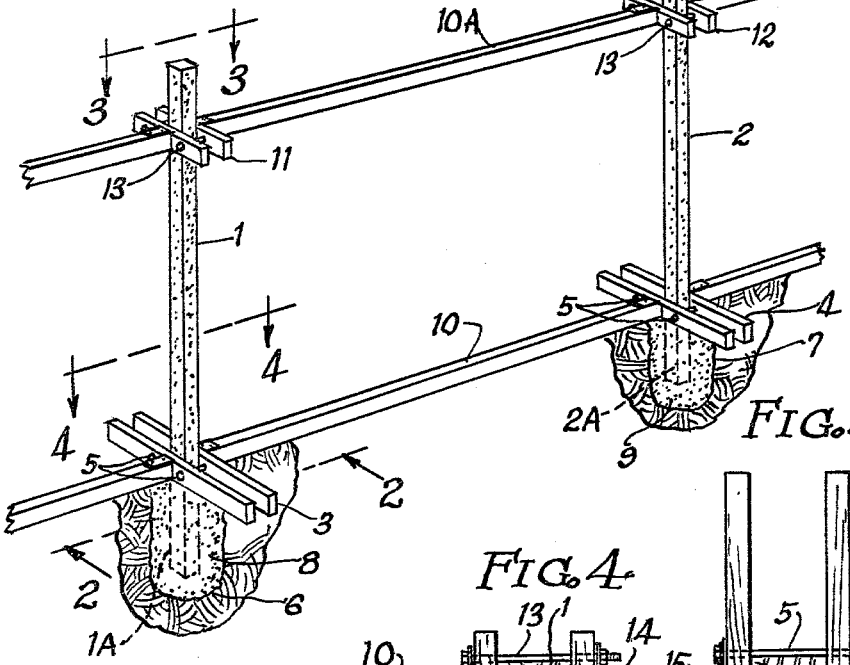
FIG. 1 is an overall perspective view of two preformed posts within dugholes showing the interlocking relationship between clamps and space bars.

Referring now to the drawing, a post 1 is shown spatially disposed from a post 2. Clamps 3,4 are tightened down by bolts 5 proximal to dugholes 6,7. The distal ends 1A,2A are shown embedded in matrices 8,9. A first space bar 10 lies perpendicular to clamps 3,4 and interlockingly mates at the clamp/space bar juncture as will be more fully described. Clamps 11, 12 are tightened down by bolts 13 on the upper portion of posts 1,2. Space bar 10A interlockingly engages clamps 11,12 in identical manner as space bar 10 and clamps 3,4.

Figure 2:
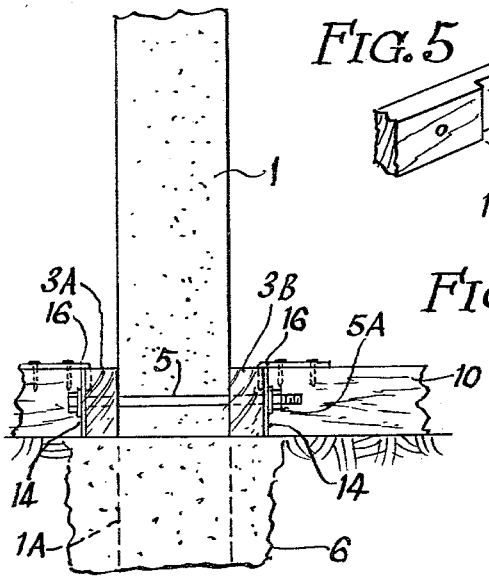
FIG. 2 is a section taken along line 2—2 of FIG. 1.

FIG. 2 shows a cross section viewed in the manner shown in FIG. 1 of line 2—2. A post 1 rests in dughole 6 at its end portion 1A. The clamping assembly is illustrated by clamp members 3A, 3B tightened down by bolt 5 which is secured by nut 5A.

Figure 3:
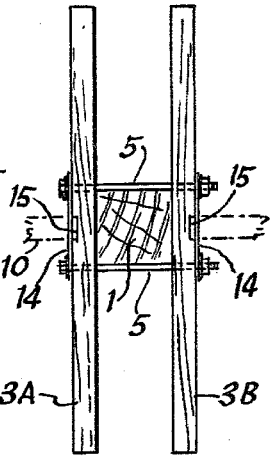
FIG. 3 is a section taken along line 3—3 of FIG. 1.
Figure 4:
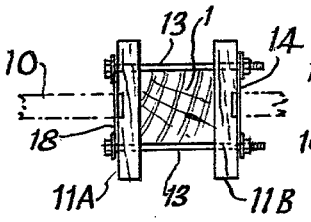
FIG. 4 is a section taken along line 4—4 of FIG. 1.
Figure 5:
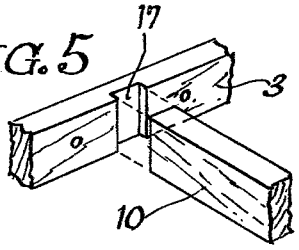
FIG. 5 is a perspective view showing another mode of interlocking relationship between a clamp and space bar.
Figure 6:
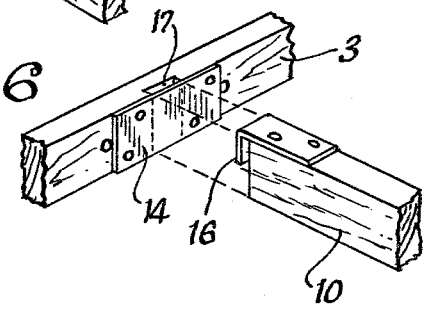
FIG. 6 is a perspective view showing the use of a projecting flange of a space bar.

The lower clamping device is seen in FIG. 3 where elongated members 3A, 3B are shown in top plan view. Plates 14 are secured over recesses 15 which are dimensioned to receive downward projecting flange 16 of a space bar 10 (as shown in FIG. 6). FIG. 5 exemplifies another means of snugging up the space bar 10 into a recess 17 of a clamp. The upper clamping device is shown in FIG. 4 where elongated members 11A, 11B are secured by nut and bolt assembly 13. Recesses in 11A, 11B are covered by plates 18 and are dimensioned to receive the flange 16 of a space bar 10.

What is claimed is:

1. In the construction of fences and the like, an apparatus for accurately spacing a first post relative to a second post which comprises:

at least one securing means mounted on the first post;

at least one securing means mounted on the second post;

at least one space bar joining a securing means on the first post to a securing means on the second post;

said securing means comprising first and second crossbars held parallel and distal to one another;

means for adjustably connecting said crossbars in a clamping arrangement on opposite sides of one of said posts; and means on at least one of said cross bars for connecting with said space bar.

2. A method for using the structure claimed in claim 1 including the steps of:

placing a first post within a dughole;

tightening down said first at least one securing means or first post;

placing at least another post in a dughole spatially disposed from said first post;

securing said at least one space bar to said at least one securing means on the first post;

securing the other end of said at least one space bar to a securing means on said second post;

adjusting said securing means for vertical and horizontal accuracy;

filling in said dughole with a permanent post base-holding substance; and removing said securing means and space bars after sufficient time has elapsed for the base material to solidify.

* * * * *